US006976342B1

(12) United States Patent
Kowalevich

(10) Patent No.: US 6,976,342 B1
(45) Date of Patent: Dec. 20, 2005

(54) FULLY INTERLOCKING SYNTHETIC, SIMULATED SHAKE SIDING

(76) Inventor: Peter Kowalevich, 196 Lakeland Ave., Apt. E6, Sayville, NY (US) 11782

( * ) Notice: Subject to any disclaimer, the term of this patent is extended or adjusted under 35 U.S.C. 154(b) by 0 days.

(21) Appl. No.: 09/450,385

(22) Filed: Nov. 29, 1999

(51) Int. Cl.[7] ..... E04D 1/34
(52) U.S. Cl. ..... 52/546; 52/520; 52/545; 52/555; 52/558
(58) Field of Search ..... 52/313, 314, 316, 52/520, 558, 555, 522, 545; 24/295, 297, 24/546, 563

(56) References Cited

U.S. PATENT DOCUMENTS 3,593,479 A * 7/1971 Hinds et al. ..... 52/313
3,738,076 A * 6/1973 Kessler ..... 52/545 X
4,015,391 A * 4/1977 Epstein et al. ..... 52/520
4,343,126 A * 8/1982 Hoofe, III ..... 52/313
4,435,933 A * 3/1984 Krowl ..... 52/520 X
4,450,665 A * 5/1984 Katz ..... 52/522
4,782,638 A * 11/1988 Hovind ..... 52/520 X
5,076,037 A * 12/1991 Crick et al. ..... 52/520
5,249,402 A * 10/1993 Crick et al. ..... 52/520 X
5,537,792 A * 7/1996 Moliere ..... 52/555 X

* cited by examiner

*Primary Examiner*—Carl D. Friedman
*Assistant Examiner*—Yvonne M. Horton
(74) *Attorney, Agent, or Firm*—Mitchell A. Stein; Stein Law, P.C.

(57) ABSTRACT

An interlocking rectangular sheet of simulated shakes for lock-up assembly upon a structure in an upwardly directed fashion having a thermo-formed base sheet with an exposure surface and a top and bottom surface. The bottom surface terminates in a cross-sectionally "U" shaped, clipping member. The top surface has a plurality of punched key portions, certain of which having apertured, flanged, assemblies thereon. All of the key portions allow for receiving securing members for attachment of the sheet to the structure, including the flanged portions. The apertured, flanged assemblies and the clipping members cooperate positively to interconnect in the upwardly directed fashion to provide, when secured to the structure by the securing members, a substantial inability to be removed or displaced by weather conditions. The flanged assemblies have an extended "S" shaped configuration. The front and back of each of the sheets have an upward and lower notched portion that provides for longitudinal engagement, one sheet against the other, by way of the front portion engaging the flange, and the rear portion engaging the "U" shaped clip.

3 Claims, 10 Drawing Sheets

Front View

Decorative
Panel

Shake Panel

FULLY INTERLOCKING SYNTHETIC, SIMULATED SHAKE SIDING

FIELD OF THE INVENTION

The present invention relates to the field of shake siding comprising a synthetic material for simulating natural wood effects, and more particularly to interlocking mechanisms for a lock-up shake siding.

BACKGROUND OF THE INVENTION

Over the years, exteriors of residential homes have been typically sided with materials including asbestos, wood and gypsum boards. Wood siding has come in a number of different forms, including different types of shakes (i.e., a hand-split piece of wood) with an external surface dimension or exposure of 6.5" to 14" in height, per shake and an appearance differing in wood grains, textures, and styles. Asbestos siding, now outlawed because of the toxicity associated with the material, was comprised of cement and asbestos fibers, with an exposure of 9" to 2' in height. Gypsum boards have been used to simulate wood planking.

Recently, various durable materials have been employed to replace or cover the existing exteriors. Included in such materials have been aluminum, steel, and very recently, fiberglass, polypropylene and vinyl. Fiberglass, for example shown in U.S. Pat. No. 4,015,391 to Epstein, has been short-lived in application because of rotting, thereby decreasing its longevity. Coating materials were ineffective in adherence to the fiberglass. Polypropylene suffers problems in expansion and contraction and in weatherability. Consequently, it is a product that must be painted and then sealed, thereby only providing five (5) years of warranty. ABS materials, another type of plastic, have also been recently introduced, and problems associated with cracking in cold conditions have yet to be overcome.

Accordingly, the current material of choice is polyvinyl chloride, or "PVC" with added composites to create texture, and to improve weatherability for longer lasting applications.

Siding, when applied, must secure first to the exterior of the house, and second the pieces must secure to one another. Typically a starter strip or course is first applied. Then, a sheet is attached to the starter strip and nailed to the house. Subsequent sheets must thereafter interlock to one another, in one of two possible ways. First, a "lock-up" assembly can be employed in which the interlocking occurs by way of an upwardly-directed motion. Second, a "stacking" arrangement can be employed by which the interlocking occurs by way of a downwardly-direction motion. It is generally recognized in the art that the "lock-up" assembly is preferred because assembly is quicker, and presents less stress to the attached panel as a subsequent panel is being upwardly locked in place.

The siding business has been replete with the purported inventions of others.

For example, U.S. Pat. No. 3,417,531 to Jones shows a lock-up assembly for siding having beads and legs for attachment. Jones does not show a clipping assembly, and thus suffers from impractical difficulty in detachment after the paneling is applied.

U.S. Pat. No. 3,703,795 to Mattes shows a two piece assembly system wherein a second piece (see, e.g., "retainer part" 84), separate and apart from the first piece, must be applied after the first piece is applied to retain the portions, and provide a lip for the subsequent sheet to be locked in place. Consequently, this discontinuous design is slow in assembly, and because of the two piece application, would generally be effective only where the exterior of the house has been configured with gypsum board or with the addition of a backing board.

U.S. Pat. No. 4,186,538 to Marcum, Jr. shows a metal-specific application that typically cannot be used for plastics including PVC because the upward surface of the "hooks" 13 are rolled. While metal can be deformed easily in this manner, to do so with plastics would be cost prohibitive. Moreover, as can be observed in Marcum, Jr.'s disclosure, there is no nailing or fastening means integral to the hooks 13, and thus hooks 13 are not engaged to the backing or exterior of the house. Accordingly, where a seem is first confronted by a hook 13 of a panel, there will be no engagement, and thus the entire sheet is likely to visibly detach after a short duration of use. Lastly, the clips are not displaced relative to the cross-section of the sheet, thus minimizing the ability to create an external surface texture of the siding.

U.S. Pat. No. 4,308,702 to Rajewski addresses the issue of rolling the upward surface, as shown in Marcum, Jr., by rolling a plastic piece along fold line 50. However, plastic manufacturing does not permit such heating and rolling without sacrificing flexibility and durability at the point of the fold. In other words, the sheet is first extruded, and then thermo-formed at the point of the fold and folded upon itself, it is also folded so as to provide the flange. Such two step heating is more expensive, and the result is less flexible and durable. As a result, in operation, the sheet so folded will be more liable to crack along the fold line 50, or worse, at the flange 26, and thus be in need of more frequent replacement. Additionally, flange 26 in Rajewski is co-continguous with the entire sheet, thus requiring the use of more material than is necessary to achieve the same or a better result. Reduction in the amount of material results in lower costs, and hence greater profits.

U.S. Pat. No. 4,450,665 to Katz shows an extruded panel having a flange 135 for engaging an upwardly locking lip 150 having a bead 154. Katz is important in showing a way of having a positive engagement click resulting from the specific shapes involved. However, the nailing step as shown in FIG. 7 of Katz does not provide a double thickness through which the nail must pass. Rather, it is a single thickness and the flange depends therefrom, leaving a point of natural failure at the dependent connection when the sheets are placed under wind load. Also, like Rajewski, the flange of Katz is continguous with the entire length of the panel, and thus suffers from extra material costs.

U.S. Pat. No. 4,669,238 to Kellis, et al. shows a discontinuous clip assembly. However, like in Mattes, Kellis, et al. provides a clip that is nailed as a separate stage, and can be placed by the installer at any location chosen. First, it must be observed that whenever the installer is given the option to "cut corners" in installation, the installer will. Accordingly, in operation, Kellis, et al. will eventually result in sheets that are not bound at specific distances (e.g., every 4") and thus the installation will be weaker. Also, the additional clip portion when added will only result in a single thickness that is nailed to the backing. Additionally, in the locations in which clips are not used, there is the natural tendency for sagging and bowing because of the obvious distance between the upper and lower interlocking pieces. Thus, in operation, Kellis, et al. is less than desirable.

U.S. Pat. No. 4,864,787 to Bukowski shows a double bend in the flange, thus suffering from some of the same problems indicated above. Additionally, Bukowski nails into a singe thickness, which also indicates a point of weakness. It should be appreciated that Bukowski appears to deal with the issue of edges and how sheets can connect without the need for a separate edge to be applied. This extra complication has found limited use in the industry.

U.S. Pat. Nos. 5,072,562; 5,249,402; 5,347,784 to Crick, et al. show a stack-locking mechanism, and, importantly, shows that the industry is replete with simulating the surface shakes in a manner in which each shake is identical, and the spacing between each such surface shake is identical. In this manner, the industry has heretofore only provided a simulated appearance that is so unnatural as to show that it is, in fact, not real. Apparently, heretofore no one addressed the need to vary the thickness of the lines between shakes so as to create an uneven effect more consistent with the natural material, and also to improve the shading effect.

U.S. Pat. No. 5,537,792 to Moliere shows a lock up assembly formed from a single mold, in which the nailing portion is a single thickness, the flange 40 provides a narrow opening for insertion of the interlock lip 50, and the distance between shakes, i.e., the thickness of the vertical lines between shakes, is always the same.

It is thus an object of the instant invention to provide a lock-up assembly in which the locking of the interlock lip from each lower portion of a sheet is allowed a greater entry aperture then the locking the aperture for a more positive locking effect, the nailing thickness is double the traditional thickness in that nails attach both the flange portion as well as the back portion to the backing material, and the vertical lines between shakes vary to resemble more of a natural appearance.

It is an additional object of the instant invention to provide nailing substantially co- linear with the topward portion of the interlock between the lip and flange, to thereby minimize wind distortion effects.

SUMMARY OF THE INVENTION

The various features of novelty which characterize the invention are pointed out with particularity in the claims annexed to and forming a part of the disclosure. For a better understanding of the invention, its operating advantages, and specific objects attained by its use, reference should be had to the drawings and descriptive matter in which there are illustrated and described preferred embodiments of the invention.

The foregoing objects and other objects of the invention are achieved through an interlocking rectangular sheet of simulated shakes for lock-up assembly upon a structure in an upwardly directed fashion is shown having a thermo-formed base sheet with an exposure surface and a top and bottom surface. The bottom surface terminates in a cross-sectionally "U" shaped, clipping member. The top surface has a plurality of punched key portions displaced. Certain of the key portions have independent, apertured, flanged, extruded assemblies that are welded to them. All of the key portions allow for receiving securing members for attachment of the sheet to the structure, including the flanged portions. The apertured, flanged assemblies and the clipping members cooperate positively to interconnect in the upwardly directed fashion to provide, when secured to the structure by the securing members, a substantial inability to be removed or displaced by weather conditions. The flanged assemblies have an extended "S" shaped configuration. The front and back of each of the sheets have an upward and lower notched portion that provides for longitudinal engagement, one sheet against the other, by way of the front portion engaging the flange, and the rear portion engaging the "U" shaped clip.

The features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein similar reference characters denote similar elements through the several views.

DETAILED DESCRIPTION OF THE PREFERRED EMBODIMENTS

Figure 1:
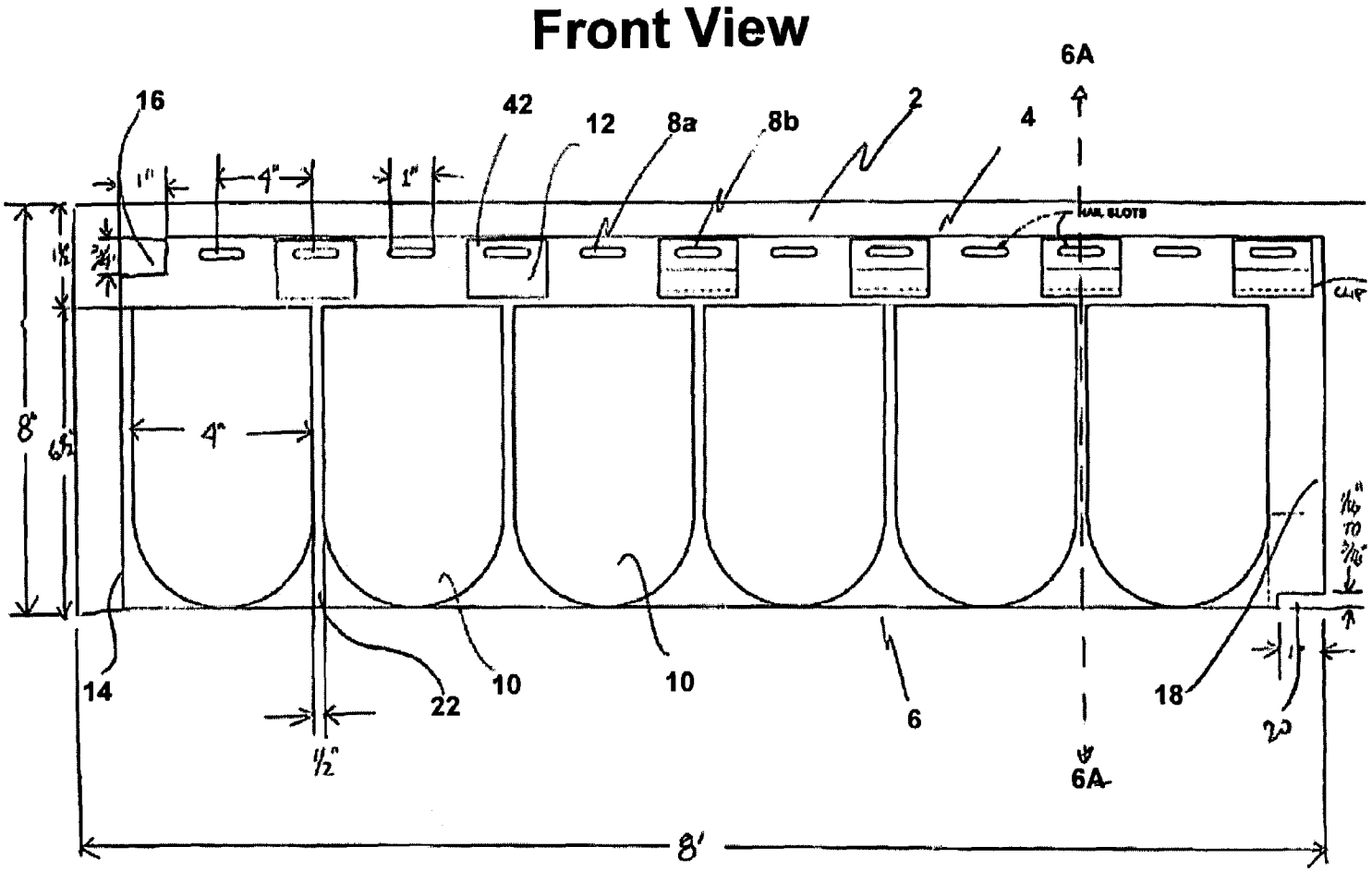
FIG. 1 is a frontal view of a sheet with a scalloped, decorative appearance in accordance with an embodiment of the subject invention.

In accordance with the subject invention, and with particular reference to FIG. 1, a sample sheet in final form 2 is shown from a frontal view, in which a decorative scalloped shakes 10 are indicated. It should be appreciated that while a scalloped shape is shown in FIG. 1, other and varied shapes can be used without deviating from the letter and spirit of the subject invention. Such other shapes include, by way of example, diamond cut, triangular cut, and any other usual and unusual shapes.

In the particular scalloped shake 10 shown in FIG. 1, each of the shakes are 4 inches wide. The sheet 2, itself, is 8 inches high, with an exposure of 6½ inches in exposure. By exposure, it is meant the actual height that is "exposed" to the elements. It is understood that the sheets in accordance with the subject invention are lock-ups, meaning that the lock upwardly from the bottom to the top, with various portions covered below the exposed height.

Sheet 2 has a top edge 4, bottom edge 6, forward edge 14 and rear edge 18. In this embodiment, sheet 2 is 8 feet in length and 8 inches in height. Sheet 2 has a forward edge notch 16 and a rear edge notch 20 for positive, longitudinal engagement, shown in greater detail in FIG. 3. In this embodiment, forward edge notch 16 is ¾ inches in height and 1 inch in width. Rear edge notch 20 is between 1/16 and 3/16 inches in height and 1 inch in width. In certain of the sheets heretofore known in the industry, the spaces between the scalloped portions are removed for appearance. However, in the subject invention the spaces remain such that the sheet is, in fact, fully rectangular in dimension. These extra spaces between the shapes thereby provide greater overall strength to the sheet, and allow the sheet to brave the elements without deformation or other physical changes that result in a change in appearance or effective protection to the underlying structure.

In the embodiment shown in FIG. 1, there is also a spacing 22 between the individual scalloped portions 10 which, in this embodiment, are fixed at a distance shown to be ½ inch.

Critical to the subject invention are the proliferation of nailing slots 8*a* and 8*b* which are equally and continually spaced parallel to the top edge 4, as shown in FIG. 1. Nailing slots 8*a* are of stretched elliptical configuration to allow the placement of a nail anywhere within the slot. It should be appreciated that this slot also provides the ability to screw or staple the sheet to the underlying backing surface. Slots 8*a* and 8*b* are 1 inch in length, and about ⅜ inches in height, with a 4 inch center to center distance between them.

Importantly, slots 8*b* have sonically welded about them a clipping flange 12. The process for keying to the slots and engaging and welding flanges 12 are described in greater detail in connection with FIG. 4A, FIG. 4B, FIG. 4C, and FIG. 4D. It should be observed that the sheet 2 can be nailed at each of slots 8*a* and 8*b*, displaced every four inches, which ensures that regardless of where an edge falls, it can be secured to the surface and thereby prevent the opportunity for wind damage at such corners or edges.

Figure 2:
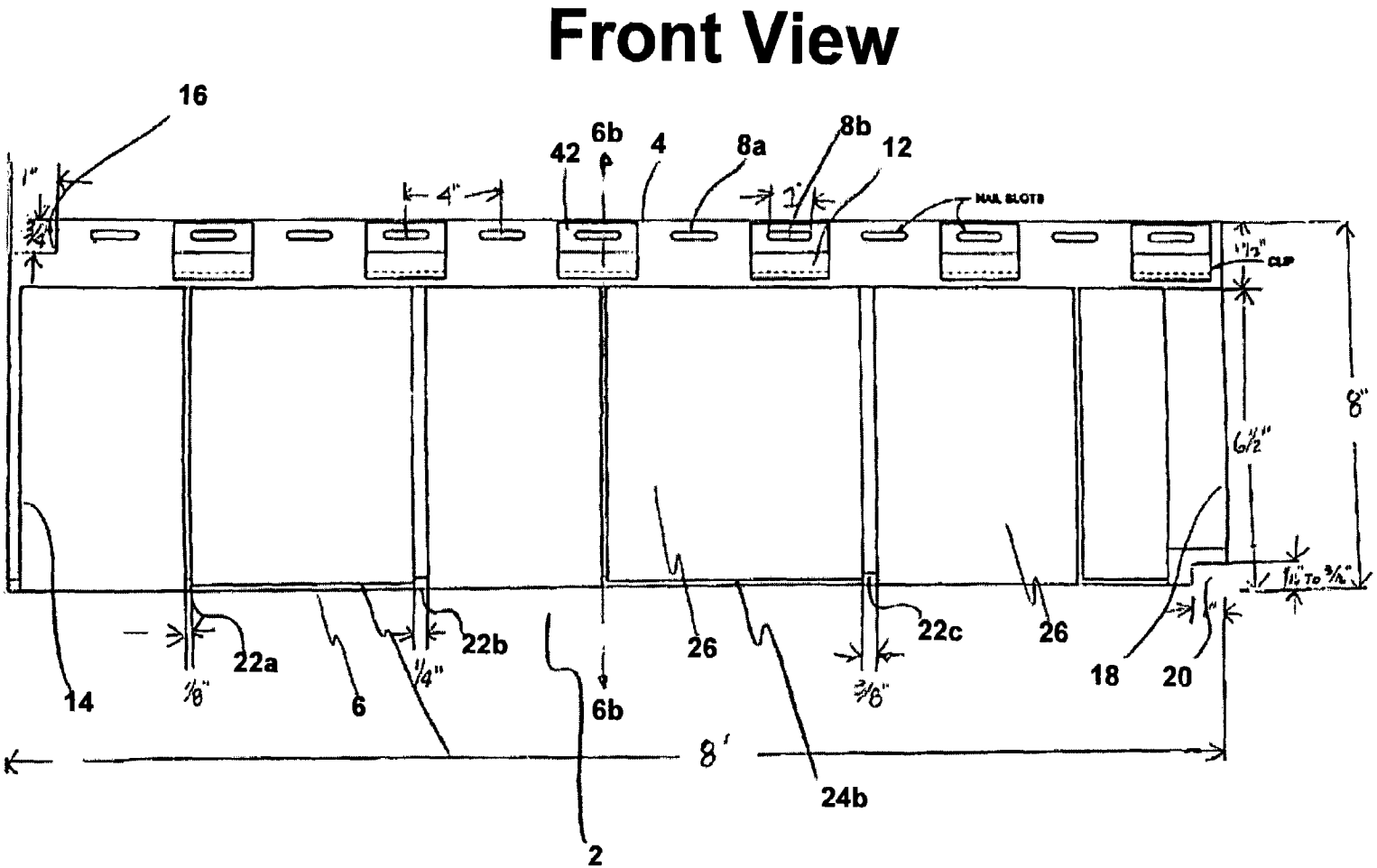
FIG. 2 is a frontal view of a sheet with a cedar shake, decorative appearance in accordance with an alternative embodiment of the subject invention.

Like FIG. 1, FIG. 2 shows a similar embodiment, in which sheet 2 is comprised of a "perfection" wood shake surface 26. Importantly, the wood shake surface 26 is configured to truly reflect a wood shake surface, in that it comprises shakes of different heights and widths as shown by 24*a* and 24*b*. As a result, the distance between the shakes varies between 22*a* of ⅛ inch, 22*b* of ¼ inch and 22*c* of ⅜ inches. It should be appreciated that other variations can be employed to simulate a real wood effect. The dimensions of this sheet are the same as that shown in FIG. 1, and like elements possess like identifying numbers.

Figure 3:
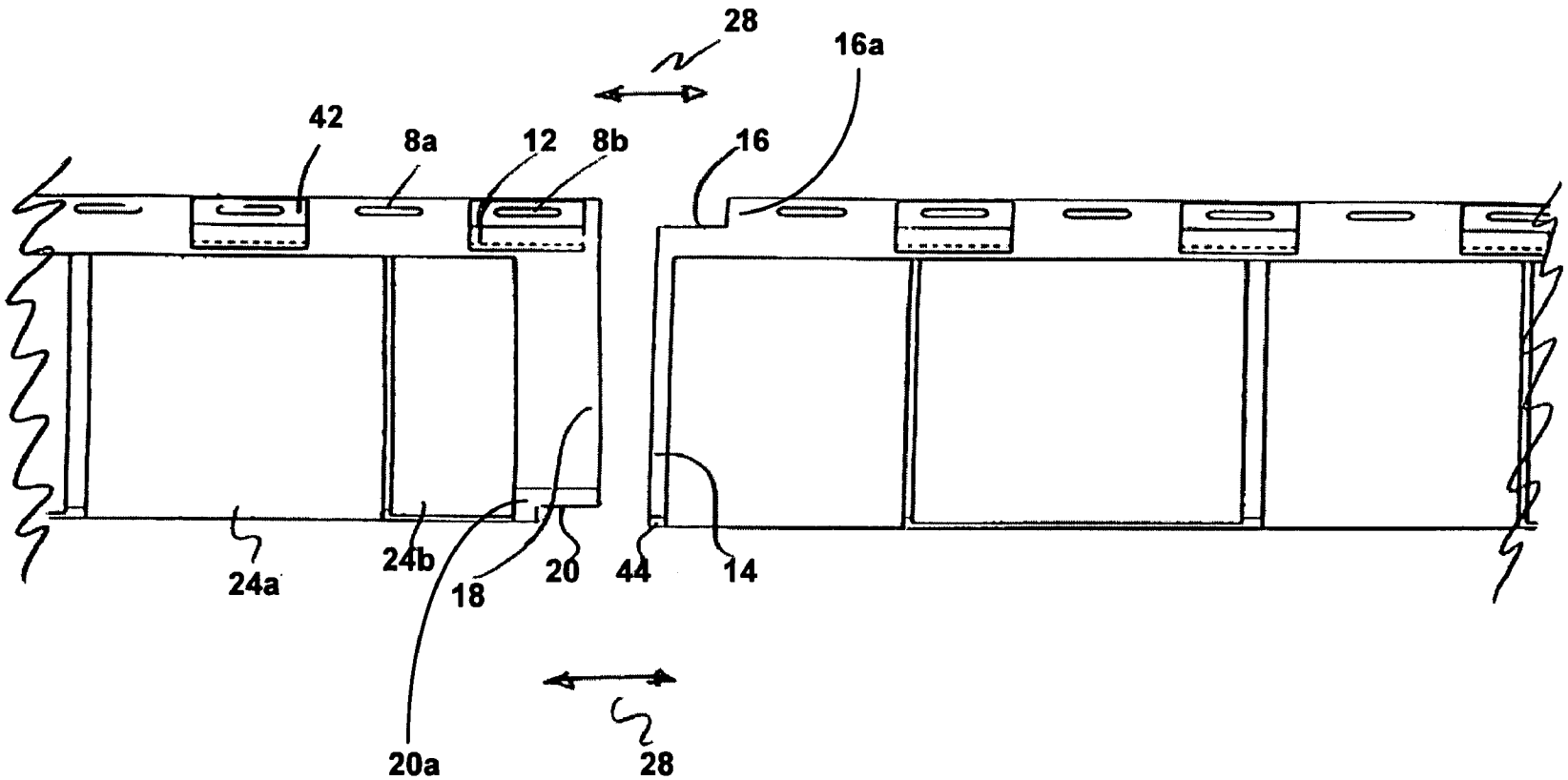
FIG. 3 is a frontal view of a forward and rear edge of the shake shown in FIG. 2 in a manner indicating cooperative, positive longitudinal interlocking.

FIG. 3 shows a rear edge 18 and forward edge 14 with notches 16 and 20 in a manner that provides positive, longitudinal interlocking between two sheets, along the direction of arrow 28. In this embodiment, notch 16 abuts flanged clipped assembly 42 perpendicular to the top edge 4, while simultaneously notch 20 slidably engages in the lower clip 44. Stops 16*a* and 20*a* as shown provide for termination of the slidable engagement while maintaining the proper distance between the panels. Clip 44 is shown in greater detail in FIG. 4B. In this manner, the two sheets connect without interruption and appear to be continuous on the wall. The spacing is established to enable the continued four inch centers between nailing slots 8*a* and 8*b*. Spacing 22 (as well as 22*a*, 22*b* and 22*c* for a wood shake) are also thereby maintained with a margin of 1/16 inch in order to provide expansion and contraction occasioned by thermal changes.

FIG. 4A, FIG. 4B, FIG. 4C and FIG. 4D, reveal the stages in development of the final sheet. In this regard, the sheet 2 is first extruded, then molded to the conformation shown in FIG. 4A, in which protruding keys 32*a* and 32*b* are provided as raised protrusions that allow accurate location of each of flanged assemblies 42. Flanged assemblies 42 comprise apertures 34 which are the same size as the protruding keys 32*a* and 32*b*, so that assemblies 42 can be placed thereupon and then sonically welded to the surface 30.

Generally the material used for all of these assemblies has a thickness of 50–53 gauge. FIG. 4B shows a cross section along line B—B of FIG. 4A, in which protrusion protruding key 32*a* is shown outwardly directed from surface 30, and surface 30*a*, comprising the front of the scallop to the bottom edge 6 is shown. It should be appreciated that any of the number of other shake appearances can be used with the configurations shown in FIG. 4A, FIG. 4B, FIG. 4C and FIG. 4D without deviating from the invention.

As further shown in FIG. 4B, the sheet 2 is continuous from its top edge 4, through the nailing key 32*a*, through surface 30, through scallop 30*a*, to bottom edge 6, and extends thereafter to form rearward clip 44. This clip 44, as described in greater detail below, mates with flange 12 for positive latitudinal interlocking of the sheets as they are attached in the lock up engagement.

Figure 4A:
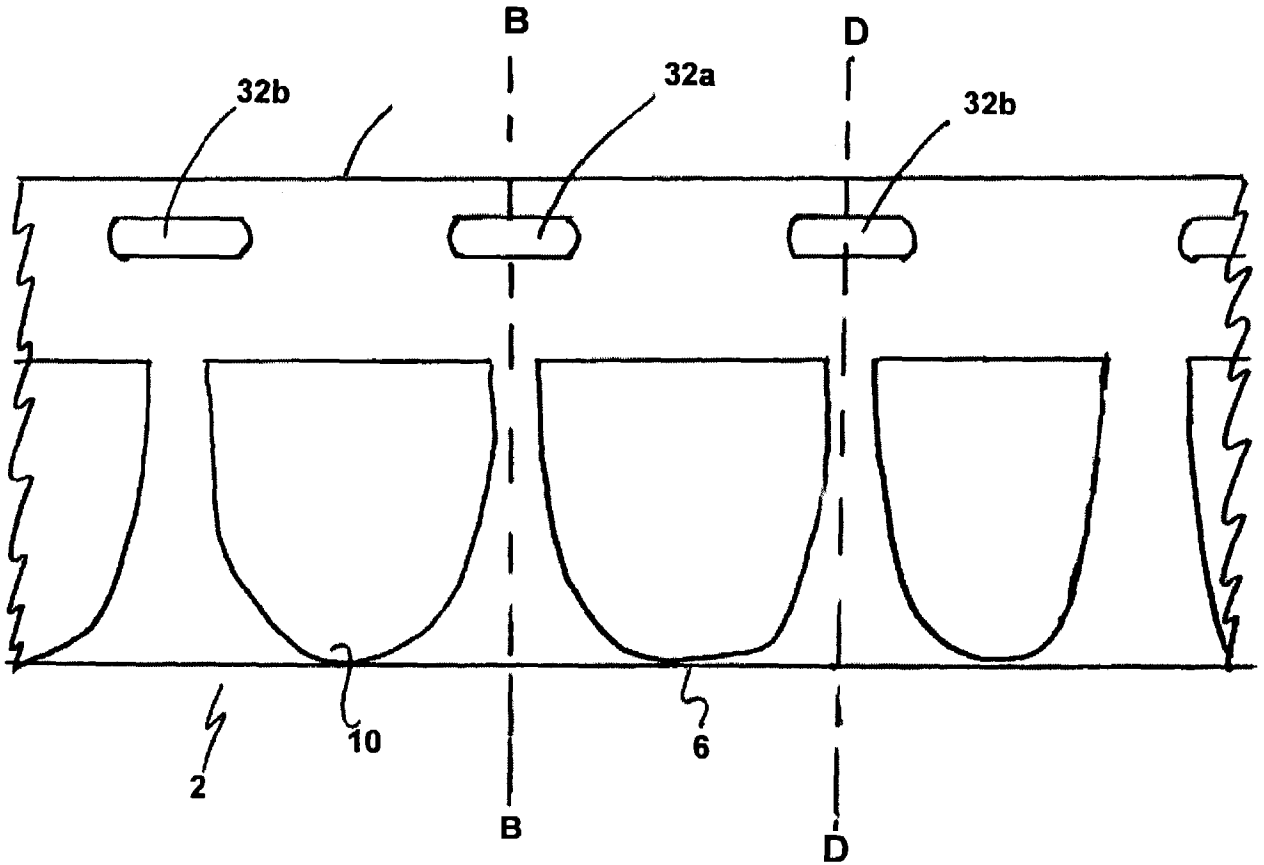
FIG. 4A shows a frontal view of a sheet prior to attachment of a clipping assembly.
Figure 4B:
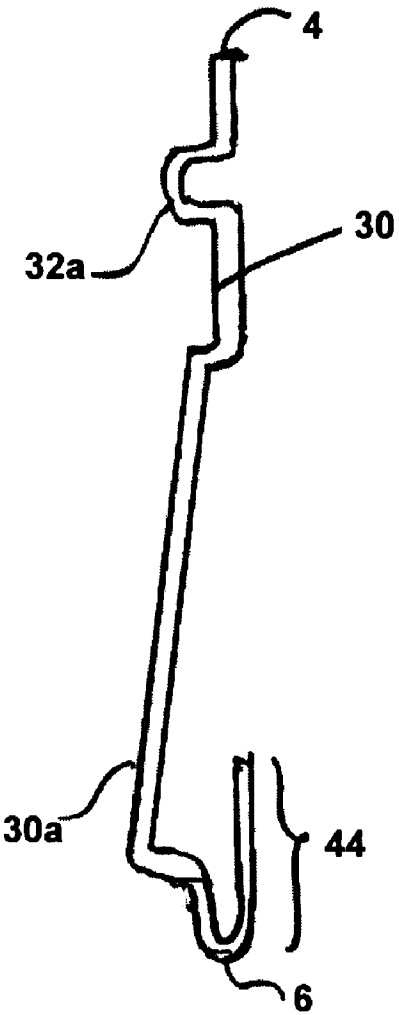
FIG. 4B is a cross-sectional view along line B—B shown in FIG. 4A.
Figure 4C:
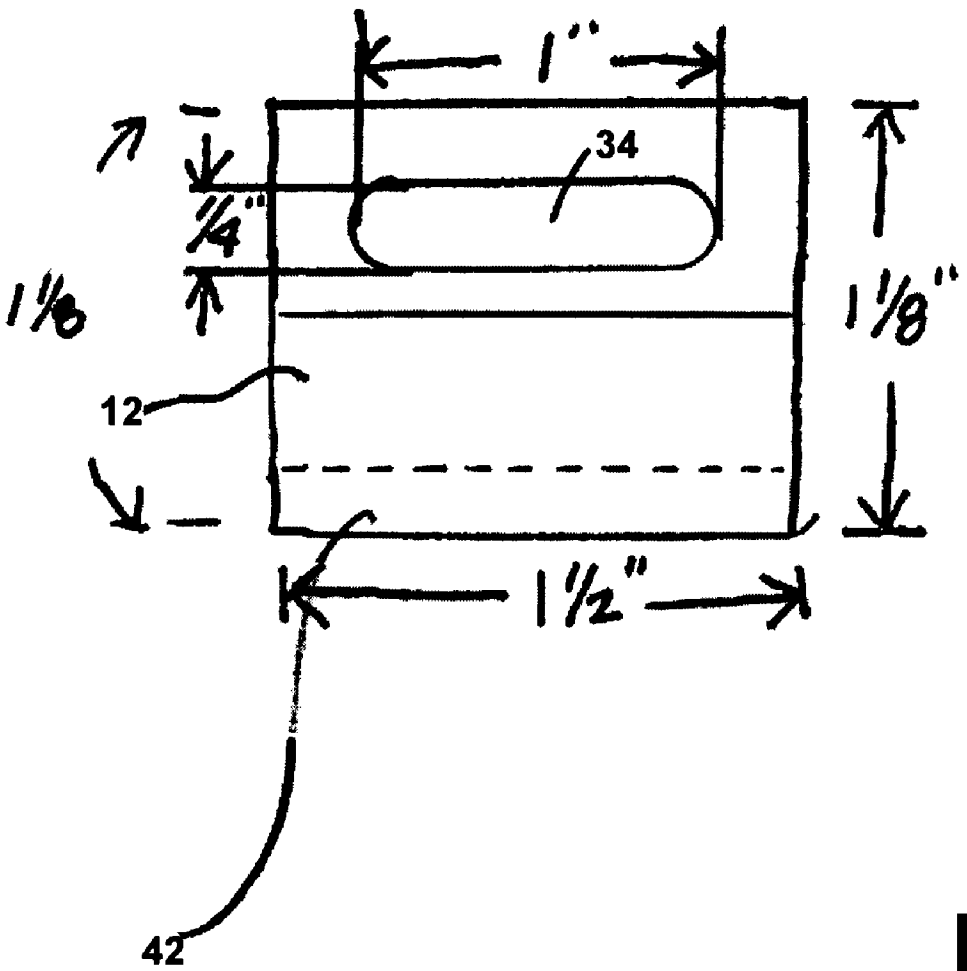
FIG. 4C is a frontal view of a clipping assembly prior to its engagement on the sheet shown in FIG. 4A.
Figure 4D:
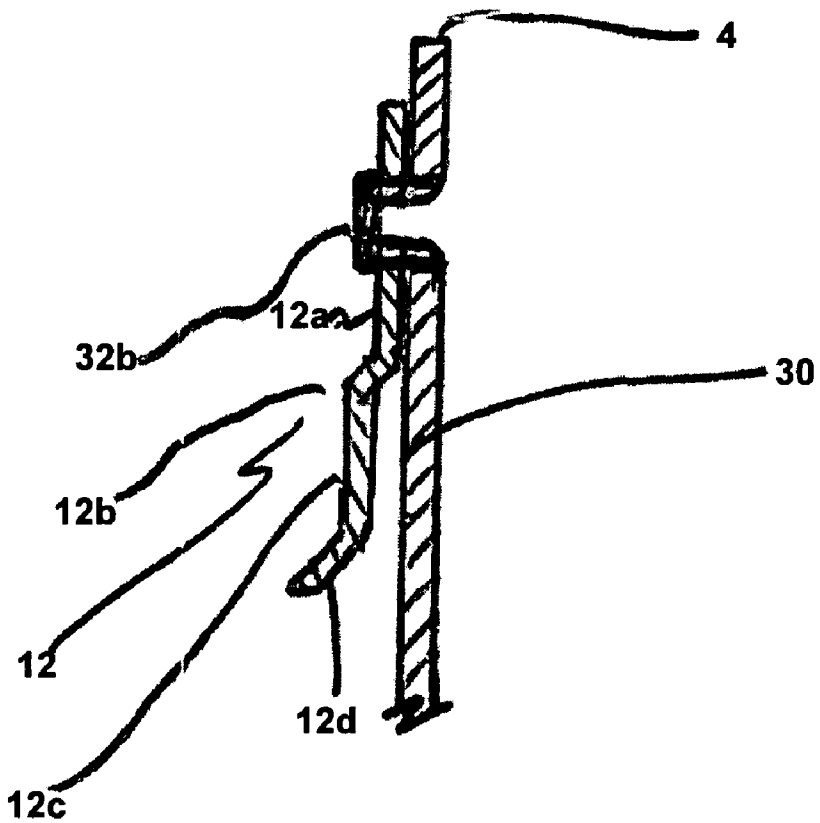
FIG. 4D is a partial cross-sectional view along line D—D of FIG. 4A.

As shown in FIG. 4D, which is a cross-section along line D—D shown in FIG. 4A with a flanged clip assembly 42 attached thereto, flanged assembly 42 has nailing key 32*b* passed through its aperture 34, and sonically welded thereupon. Flange 12 is downwardly directed in an "S" type configuration having a first portion 12*a* which resides parallel to surface 30, then to an angular deformation 12*b*, to another parallel extension 12*c*, to a final angular deformation 12*d*. In this manner, flange 12 creates an opening that is larger in size then the final width, in which the clip 44 is passed for clipped attachment.

FIG. 4B and FIG. 4D, protruding keys 32*a* and 32*b* are shown. After the sonic welding of flanged assemblies 42 about respective protruding keys 32*a* and 32*b* to surface 30, the protruding keys 32*a* and 32*b* are then punched by the sonic welder, and removed, leaving apertures 8*a* and 8*b*, as shown in FIG. 1 and FIG. 2, for nailing.

FIG. 4C shows an individual flanged assembly 42 for engagement. Alternatively, and in accordance with a present preferred embodiment, an array of two assemblies can be provided coextensively with one another as shown by the continuous dual clip assembly 36 in FIG. 5A. In this manner, two flanged assemblies 42 are connected to one another such that flanges 12 are of the same dimension as that shown in FIG. 4C. The length of this assembly 36 is preferably between 21.5 inches and 27.5 inches, still leaving the four inch centers for attachment by nailing through apertures 8*a* and 8*b* after removal of protruding keys 32*a* and 32*b*.

Figure 5B:
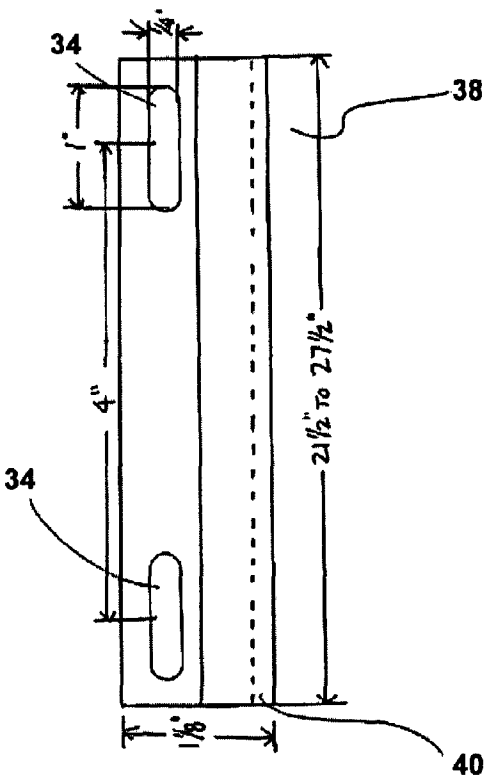
FIG. 5B is a frontal view of a continuous clipping assembly in accordance with another embodiment of the subject invention.

An alternative embodiment, as shown in FIG. 5B, has a continuous clip assembly 38, with a continuous flange 40. Apertures 34 and centers between them are still maintained.

Figure 5A:
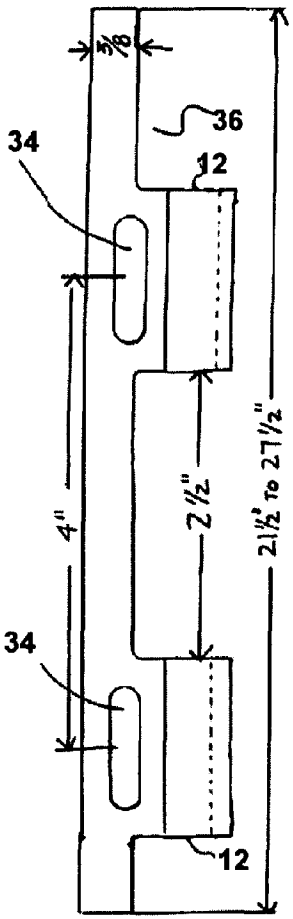
FIG. 5A is a frontal view of a continuous dual clipping assembly in accordance with the preferred embodiment of the subject invention.

It should be appreciated that the cross-section of each of the flanged portions in FIG. 5A and FIG. 5B are the same, as the flange 12 shown in FIG. 4D.

Figures 6A, 6B:
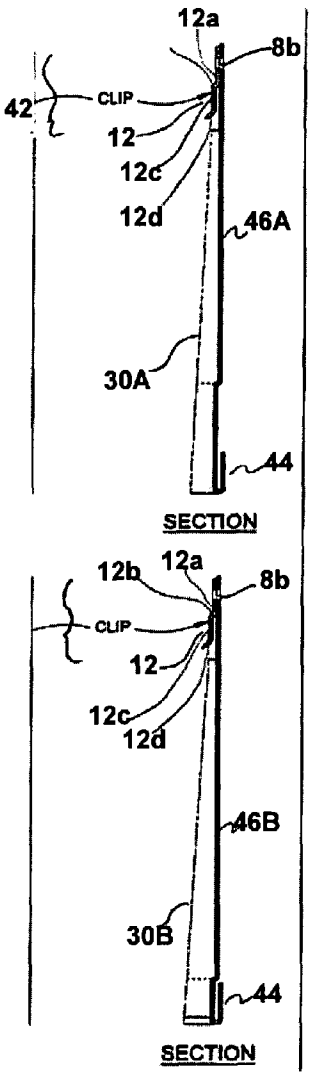
FIG. 6A is a cross-sectional view along line 6A—6A in FIG. 1.
FIG. 6B is a cross-sectional view along line 6*b*–6*b* in FIG. 2.

FIG. 6A and FIG. 6B show cross-sections along line 6A—6A of FIG. 1 and line 6*b*–6*b* of FIG. 2, for each of the decorative panel and shake panel embodiments, respectively. In this regard, apertures 8*b* are shown for nailing, indicating that the sonic removal step of the keys 32*b* has already occurred. In these cross-sectional representations, clip assembly 42 is shown, as well as the lower clip assembly 44. Surfaces 30A and 30B are shown, and back walls 46A and 46B are also shown. It should be recognized that these back walls are produced by the molding of the spaces 22 and 22*a*, 22*b* and 22*c*, thereby leaving a lesser gap for clip 44 than that shown in FIG. 4B. Because of the spacing, where independent clip assemblies 42 are used, the flange 12 will not engage at the cross-sections shown in FIG. 6A and FIG. 6B, but rather engage the cross-sectional area shown in FIG. 4B (between the spaces 22, 22*a*, 22*b*, and 22*c*).

Figure 7:
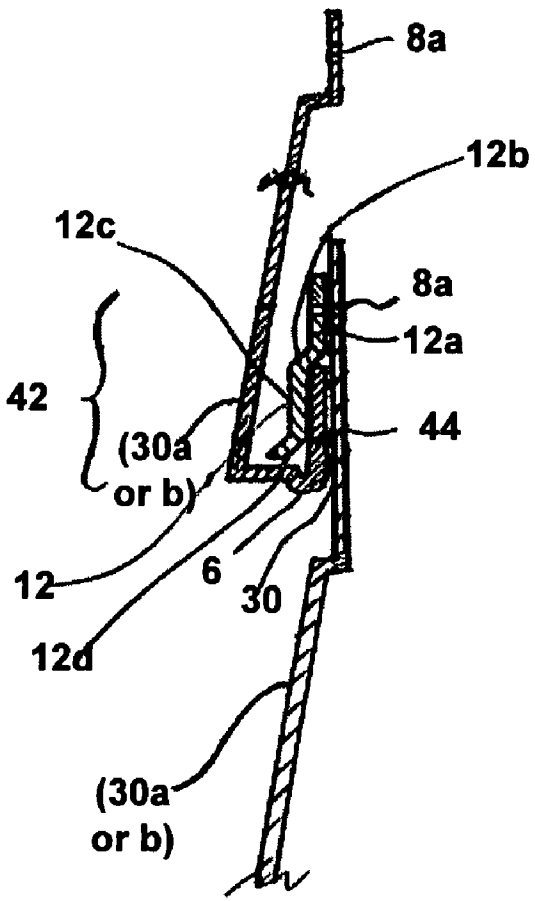
FIG. 7 is a cross-sectional view showing a flange and conforming clip in assembled formation.

Engagement between clips 44 and flanged assemblies 42 are shown in FIG. 7, which indicates the manner by which clip 44 is slidably mounted within the recesses created by flange 12. The initial extension provided by the final angular deformation 12*d* creates a larger aperture for more easily engaging the clip 44. Likewise, angular deformation 12*b* creates a distance "D" between second parallel extension 12*c* and surface 30 just slightly greater than the thickness of clip 44, thereby frictionally and compressionally engaging the clip 44, as shown in FIG. 7. In this manner, ease of assembly, with positive latitudinal interlocking is achieved.

While there have been shown, described and pointed out fundamental novel features of the invention as applied to preferred embodiments thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

I claim:

1. An interlocking rectangular sheet of simulated shakes for lock-up assembly upon a structure in an upwardly directed fashion, the sheet having a top and a bottom location, the top location at a level higher than the bottom location, comprising:

(a) a thermo-formed base sheet having an exposure surface;

(b) a cross-sectionally "U" shaped, clipping member configured substantially along the bottom location of the sheet and below said exposure surface;

(c) a plurality of punched key portions displaced along the top location of the sheet and above said exposure surface;

(d) a plurality of apertured, flanged, assemblies located about less than all of said punched key portions, such that all of said apertures on said flanged assemblies and all of said punched key portions that lack said flanged assemblies, provide locations for receiving securing members for attachment of the sheet to the structure;

(e) such that said apertured flanged assemblies and said clipping member cooperate positively to interconnect in the upwardly directed fashion to provide, when secured to the structure by the securing members, a substantial inability to be removed or displaced by weather conditions; and (f) wherein said base sheet further comprises a front portion and a back portion that are substantially perpendicular to the top and bottom locations, and said front portion has a top notch proximate to the top location, and said back portion has a bottom notch proximate to the bottom location, such that said sheet is capable of secured, interlocking, longitudinal attachment to a second identical sheet by said top notch of said sheet overlapping the top surface and slidably engaging one of said flanged assemblies of said second sheet, and said bottom notch of said sheet underlapping said "U" shaped clipping member of said second sheet for slidable engagement into the "U" portion thereof.

2. The sheet of claim 1, wherein the top portion of the sheet defines a top surface above said exposure surface, and said flanged assemblies comprise a cross-sectional conformation having a first portion parallel to and abutting said top surface, a second portion angularly, outwardly deformed from said first portion, a third portion extended substantially parallel to said first portion, and a fourth portion angularly, outwardly deformed from said third portion, thereby creating an aperture for receiving a "U" shaped clipping member from a second sheet and channeling said second sheet clipping member into secured, interlocking upwardly-directed attachment between said top surface and said first portion.

3. The sheet of claim 1, where the top notch of said sheet possesses a stop portion for abutting said one of said flanged assemblies of said second sheet.

* * * * *